US007424958B1

(12) United States Patent
Eley

(10) Patent No.: US 7,424,958 B1
(45) Date of Patent: Sep. 16, 2008

(54) STORAGE AND ORGANIZATION SYSTEM FOR ARTICLES

(76) Inventor: John H. Eley, 86651 514th Ave., Orchard, NE (US) 68764

( * ) Notice: Subject to any disclaimer, the term of this patent is extended or adjusted under 35 U.S.C. 154(b) by 544 days.

(21) Appl. No.: 11/058,832

(22) Filed: Feb. 16, 2005

(51) Int. Cl.
*A47F 7/00* (2006.01)

(52) U.S. Cl. ..... 211/70.6

(58) Field of Classification Search ..... 211/70.6, 211/194, 57.1, 54.1, 59.1, 189, 198; 248/220.31, 248/220.41, 220.21, 243; 108/106
See application file for complete search history.

(56) References Cited

U.S. PATENT DOCUMENTS 4,410,095 A * 10/1983 Dembicks ..... 211/70.6
4,770,297 A * 9/1988 Chang ..... 206/379
4,951,827 A * 8/1990 Moransais ..... 211/59.1
5,671,852 A * 9/1997 Maharg ..... 211/189
6,244,447 B1 * 6/2001 Frieze et al. ..... 211/85.13
6,702,128 B2 3/2004 Winig et al. ..... 211/90.01
D498,634 S 11/2004 Winig et al. ..... D6/571

* cited by examiner

*Primary Examiner*—Sarah Purol
(74) *Attorney, Agent, or Firm*—Holland & Hart LLP

(57) ABSTRACT

A storage system is provided with a support panel, having a plurality of sockets, and one or more support members, having mounting posts for engagement within the sockets. Nodules extend from the sides of the mounting posts that are received within recesses formed in the inner walls of the sockets to secure the mounting posts within the sockets. A modular design permits a plurality of support panels to be joined at their edges, to form a larger support panel, or to engage the edge of one panel with the face of another panel to provide a storage shelf. In one embodiment, a horizontal platform and vertical handle both provide surfaces for receiving support members while permitting the device to be mobile.

20 Claims, 15 Drawing Sheets

STORAGE AND ORGANIZATION SYSTEM FOR ARTICLES

BACKGROUND OF THE INVENTION

1. Field of the Invention

The present invention relates to storage systems, and more particularly to modular storage systems that are easily adaptable for the vertical and horizontal storage of a wide range of articles having various shapes and sizes.

2. Description of the Prior Art

Organization and storage of tools and other small articles at home and in the work place can be challenging. This is especially true when the articles must be stored in a manner that provides quick and easy access. Such storage systems should provide neat organization and the flexibility of short or long-term storage. Moreover, such storage systems are often times used in a garage or workshop, which necessitates a heightened level of durability in order to provide a long useful life.

The ubiquitous storage system, commonly found in garages and workshops, includes one or more sheets of perforated board or "pegboard" that is secured to a wall. A plurality of small wire hangers are used to support tools and various articles from the pegboard. Small diameter hooks at the rearward ends of the hangers are shaped so that they may be passed through the openings in the pegboard and then rest against the backside of the pegboard when the forward end portion of the hanger is in place, closely adjacent the front surface of the pegboard. Unfortunately, such systems are not very durable due to the pressed composite board material used to fabricate the pegboards. Over time, the diameter of the pegboard openings begin to expand and create an ill-fitting connection for the hangers. Moreover, the apparatures of standard pegboard are round, which permit rotation of the hanger within the openings, creating a fairly unstable platform for the storage of heavy or unbalanced articles.

Another serious disadvantage to the use of pegboard, and similar storage systems, is the fact that the pegboard itself must be secured in a spaced relationship with a mounting surface in order for the hangers to be secured with the pegboard. Most such systems pass the mounting end of the hangers completely through the pegboard and then utilize the rearward surface of the pegboard as a bracing surface for the mounting end of the hanger. Accordingly, this requires that spacers be used when mounting the pegboard to an operating surface, such as a garage wall. The spacers are typically positioned behind the pegboard, along the peripheral edge and sporadically throughout the middle portions of the pegboard, depending upon the size of the pegboard. Unfortunately, wherever a spacer is used, an apparature is filled with a fastener that passes through the spacer on the opposite side of the pegboard. The use of such small spacers creates instability in the pegboard material, causing it to wobble when articles are coupled with or removed from the pegboard. Where spacers are used that are too short, an insufficient space between the backside of the pegboard and the mounting surface is provided to accommodate the mounting end of the hanger. Accordingly, the system must be disassembled and each of the short spacers must be replaced with taller spacers.

Another disadvantage of using prior art storage systems, such as pegboard, is the inflexibility of their use. These prior art systems are designed to hang vertically, in a spaced relationship with a wall or other mounting surface. Due to the mechanical nature in which most hangers are passed through the pegboard apparatures and brace themselves against the rearward surface of the pegboard, prior art storage systems cannot be positioned horizontally to support and store a wide range of articles. Accordingly, such storage systems are inappropriate for use in designing portable storage systems. This, combined with the typically flimsy nature of pegboard, further contributes to the fact that the pegboard materials are not used as horizontal shelves that can be, in turn, secured to vertically mounted sections of pegboard.

Accordingly, what is needed is a new storage system for articles that is modular and flexible in design, durable enough to withstand repeated, long-term use, and simple enough to use for a wide range of different applications.

SUMMARY OF THE INVENTION

The storage system of the present invention is generally provided with a support panel having first and second surfaces, a peripheral edge portion, and a plurality of evenly spaced sockets. At least one support member is also provided, having at least one mounting post that extends outwardly from one end of the support member. The mounting post is shaped and sized to be at least partially received within at least one of the plurality of sockets in the support panel. In a preferred embodiment, the mounting post is provided with at least one nodule that extends outwardly from a side portion of the mounting post. The nodule is shaped and sized so that it may be releasably receivable within a recess formed within an interior sidewall of the support panel socket. In this manner, the support member snaps in place, adjacent the first surface of the support panel. The support member may be easily removed by pulling the support member until the mounting post is extracted from the socket. The support member may then be repositioned to any other socket in the support panel. In a preferred embodiment, the mounting post and socket are shaped to have a polygonal cross-section so that rotation of the mounting post within the socket is limited.

In one preferred embodiment, the storage system is provided to be modular in construction, providing at least one side socket that extends into the peripheral edge portion of the support panel. A second support panel is provided in a similar construction to the first support panel and includes at least one mounting post that extends from the peripheral edge portion of the second support panel. The side socket and the side mounting post are shaped and sized to be releasably engageable with one another, permitting the support panels to be securely coupled to one another in an edge-to-edge fashion when secured to an operating surface. Openings may be formed transversely through the side socket and the side mounting post in such a manner that the openings align with one another when the post is disposed within the socket. In this manner, a mounting apparature is provided to receive a fastener that will secure the two panels to the operating surface.

In another embodiment, a second support panel that is constructed in a manner similar to the first support panel may be provided in a narrow but elongated shape. One or more side mounting posts may be provided to extend outwardly from the peripheral edge portion of the second support panel. This arrangement permits the second support panel to be releasably secured to the first support panel in a generally perpendicular orientation. This arrangement provides for a modular shelf to support various articles. In still another embodiment, the support member is provided with an upper mounting post that extends from an upper edge portion of the support member and is sized and shaped to be at least partially received within at least one socket formed in the second support panel, such that the support member extends in a generally perpendicular fashion from the support panel. A mounting post extending from the rearward edge of the support member may be coupled within a socket in the first support panel when the second support panel is secured to the first face of the first support panel, serving as a brace for the shelf that is formed by the second support panel. Sockets may be formed in the support member for receiving the mounting posts of other support members, which will be utilized to individually support various articles.

In another preferred embodiment, a first elongated sleeve is coupled to one end of the support member and is provided with an inner cavity that is in open communication with an open upper end portion of the sleeve. Accordingly, the support member may be coupled with the support panel in a manner that permits the sleeve to hold various articles, including the handle portion of a fishing rod. Additional sleeves may be coupled in a generally parallel fashion with the sides of the first sleeve to receive additional articles for storage. In a different embodiment, the mounting post may extend outwardly from a lower end portion of the first elongated sleeve so that the sleeve may be secured to a horizontally disposed platform, having one or more sockets that are positioned to receive the mounting post. The support panel may also be provided in an elongated, slender shape, having a mounting post that extends outwardly from a first end of the peripheral edge portion of the support panel. The mounting post may be releasably received within a handle socket formed in the platform, permitting the support panel to be used as a handle to move and reposition the platform. A base may also be provided with an upper bearing surface that is rotatably received within a recess formed in the lower surface of the platform. In this arrangement, a "lazy susan" is provided.

It is therefore a principal object of the present invention to provide a modular system capable of storing a wide range of articles.

A further object of the present invention is to provide a storage system wherein support members are releasably secured within one or more sockets in a support panel.

Still another object of the present invention is to provide a storage system that may be secured in vertical or horizontal positions.

A further object of the present invention is to provide a storage system having a support panel and one or more support members that are releasably engageable with the support panel, while the support panel is positioned flush with a mounting surface.

Still another object of the present invention is to provide a storage system that is sufficiently durable for repeated, long-term use.

Yet another object of the present invention is to provide a storage system having a plurality of support panels that may be joined at their peripheral edges, using posts and sockets along the peripheral edges of the support panels, to create a large support panel.

A further object of the present invention is to provide a storage system having a horizontal base platform and a generally vertical handle, wherein either or both of the base platform or the handle may releasably receive support members for the storage of articles.

Yet another object of the present invention is to provide a "pegboard-style" storage system that is easily moved from one location to another while storing a plurality of articles.

These and other objects of the present invention will be apparent to those having skill in the art.

DESCRIPTION OF THE PREFERRED EMBODIMENT

Figure 1:
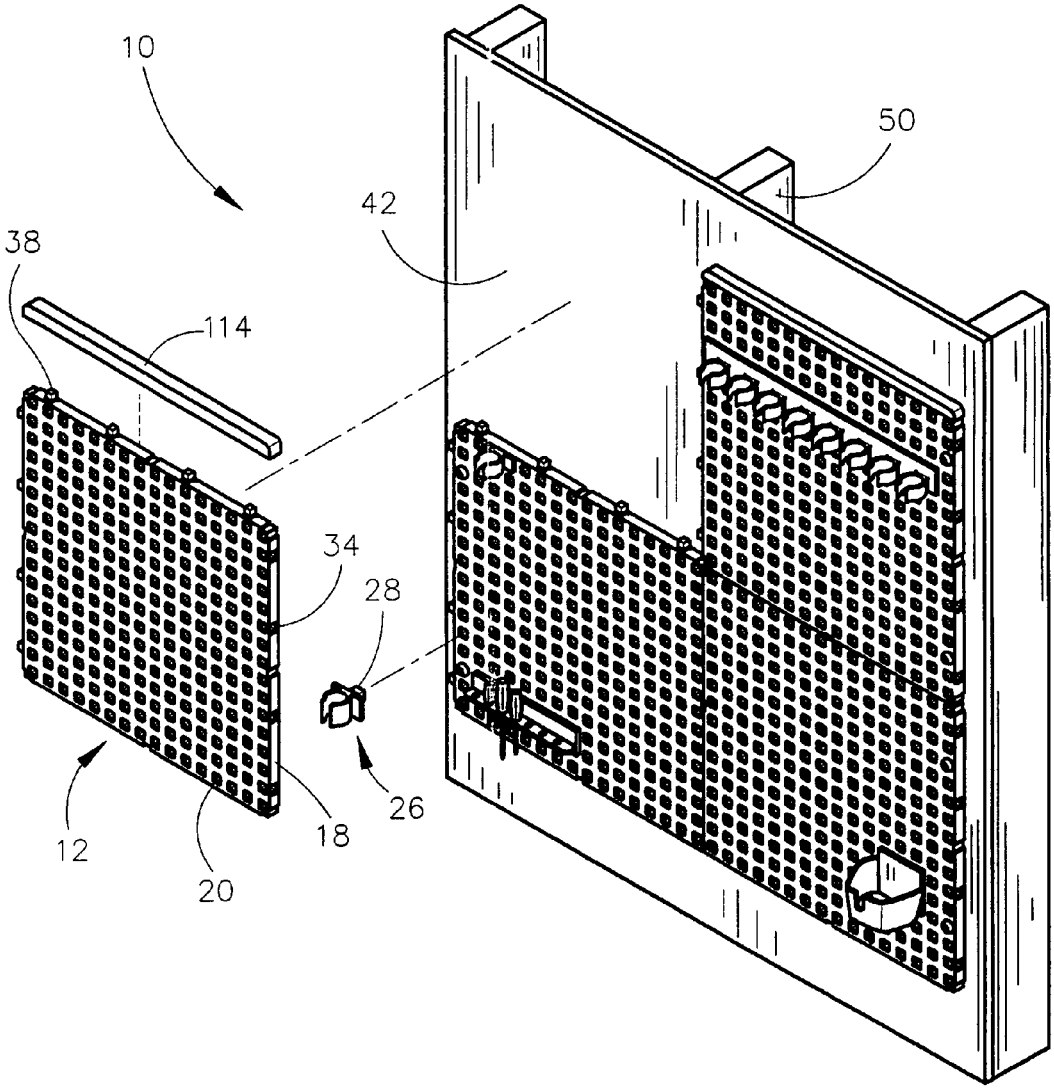
FIG. 1 is a perspective view of one embodiment of the storage system of the present invention.
Figure 2:
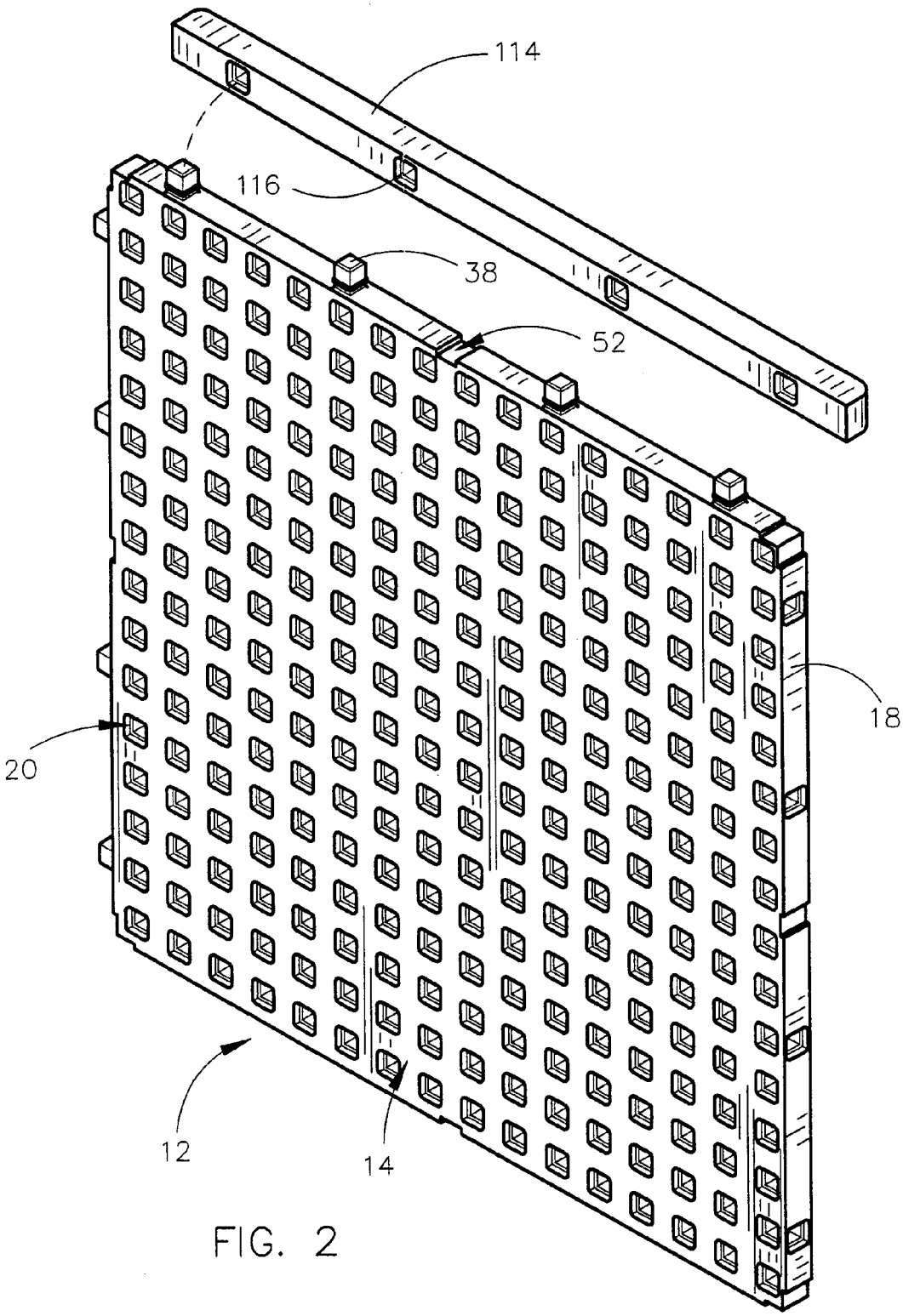
FIG. 2 is a front isometric view of one embodiment of a support panel utilized by the storage system of the present invention.
Figure 4:
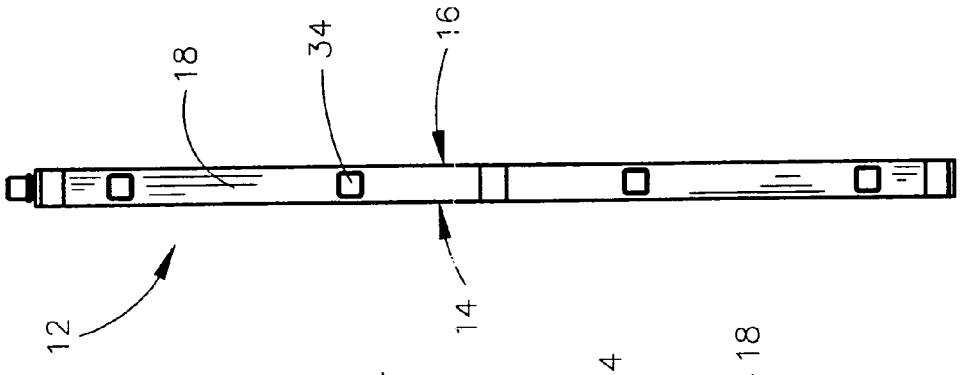
FIG. 4 is a side elevation view of the support panel depicted in FIG. 2.
Figure 3:
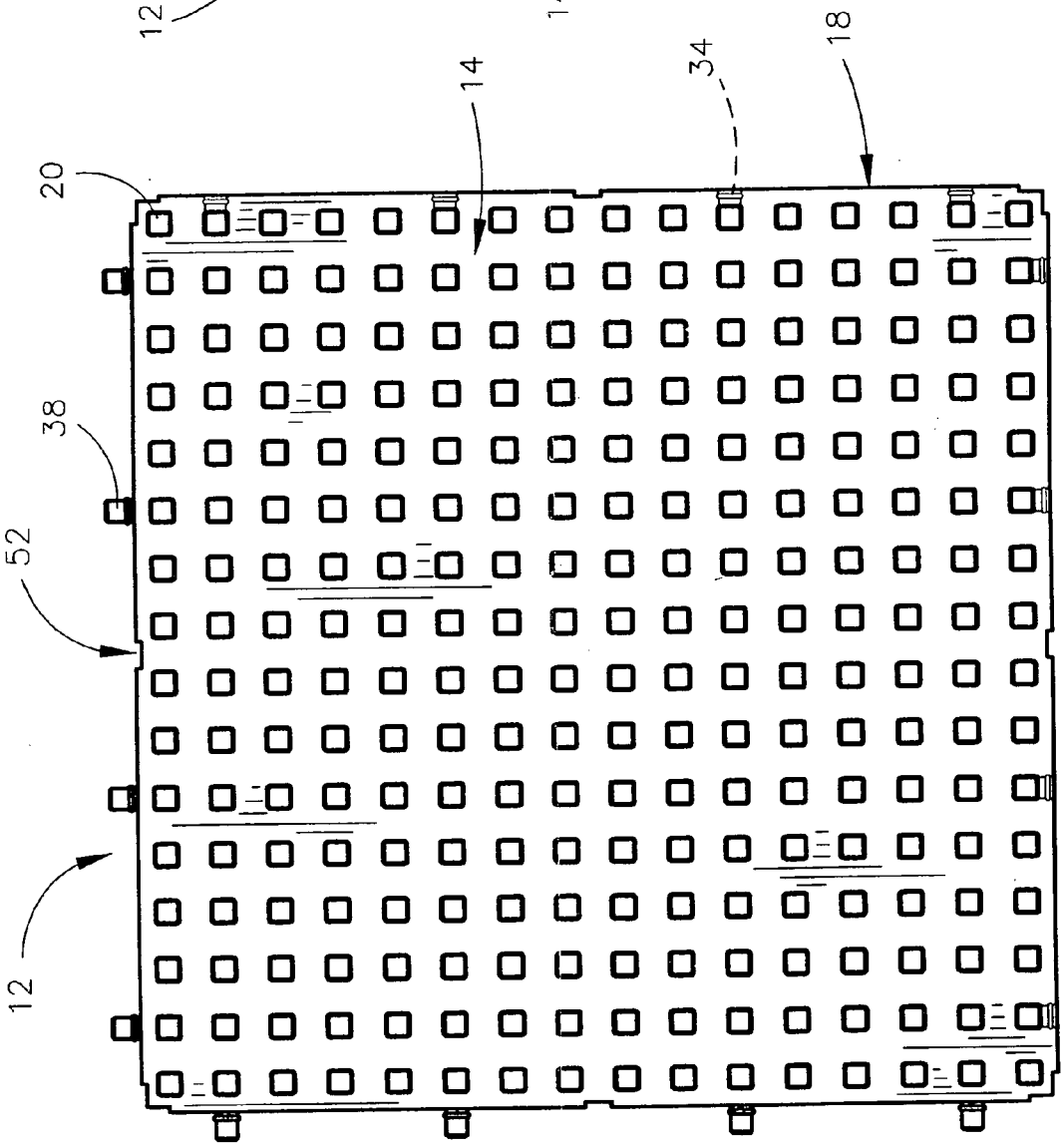
FIG. 3 is a front elevation view of the support panel depicted in FIG. 2.

In the following detailed description of exemplary embodiments, reference is made to accompanying FIGS. 1-19, which form a part hereof and show by way of illustration exemplary embodiments of the present invention. These embodiments are disclosed in sufficient detail to enable those skilled in the art to practice the invention. It is to be understood that other embodiments may be utilized, however, and other changes may be made, without departing from the spirit or scope of the present invention. The following detailed description is, therefore, not to be taken in a limiting sense, and the scope of the present invention is defined only by the appended claims.

The storage system 10 of the present invention is generally provided with a support panel 12, having a first surface 14, a second surface 16 and a peripheral edge portion 18. A plurality of sockets 20 extend into the support panel 12 from a plurality of openings formed the first surface 14. The sockets 20 are preferably oriented in an evenly spaced relationship with one another. The sockets 20 are each provided with at least one interior sidewall 22 having a recess 24 that extends in a generally transverse direction into the support panel 12. The sockets 20 are each provided with a depth that preferably terminates prior to the socket 20 extending through the second surface 16 support panel 12. However, as discussed in greater detail herein, certain applications may make it desirable to extend one or more of the sockets 20 completely through the support panel 12.

Figure 5A:
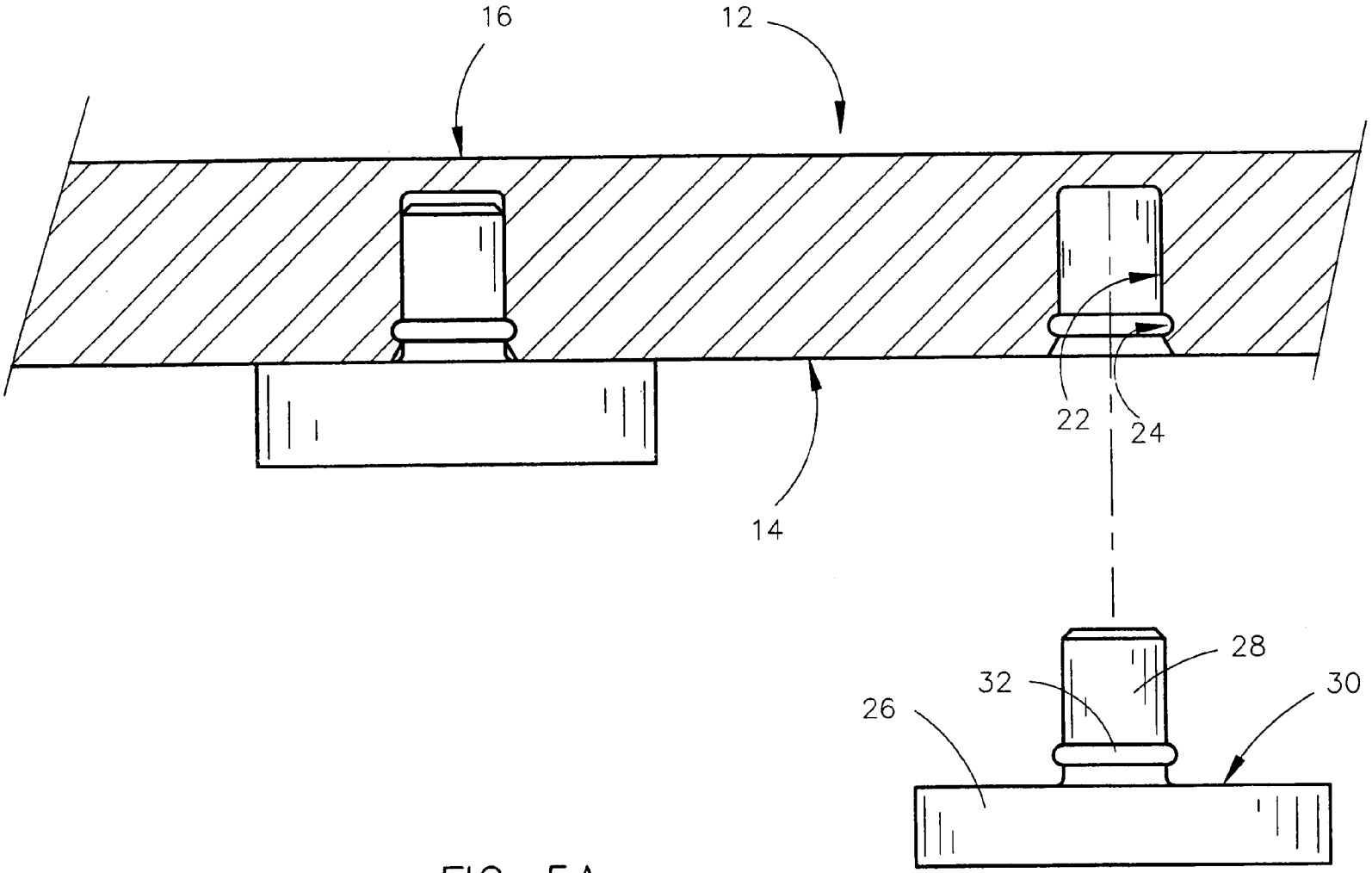
FIG. 5A is a partial cutaway view of one embodiment of the storage system of the present invention.

At least one support member 26 is also provided, having at least one mounting post 28 that extends outwardly from a first end portion 30 of the support member 26. The mounting post 28 is preferably shaped and sized to be at least partially received within at least one of the plurality of sockets 20 in the support panel 12. In a preferred embodiment, the mounting post 28 is provided with at least one nodule 32 that extends outwardly from a side portion of the mounting post 28. The nodule 32 is shaped and sized so that it may be releasably snapped into place within the recess 24 in the interior sidewall 22 of the socket 20. In this manner, the support member 26 is placed in a secure position adjacent the first surface 14 of the support panel 12, as depicted in FIG. 5A. The support member 26 may be easily removed by pulling the support member 26 until the nodule 32 and the mounting post 28 are extracted from the recess 24 and the socket 20. The support member may then be repositioned to any other socket 20 in the support panel 12. In a preferred embodiment, the mounting post 28 and socket 20 are each shaped to have a polygonal cross-section, such as a triangle, square, rectangle, etc., so that rotation of the mounting post 28 within the socket 20 is limited. However, round or curved cross-sections are contemplated.

It is contemplated that the combined diameters of the mounting post 28 and the nodule 32 will exceed the diameter of the socket 20 (excluding the diameter of the recess 24), so that the nodule 32 extends into the recess 24 to resist the unintentional withdrawal of the mounting post 28 from within the socket 20. A greater or lesser degree of tolerances are contemplated in order to provide a stronger or weaker structural bond between the nodule 32 and the recess 24. In order to accommodate the passage of the nodule 32 through the socket 20, until it reaches the recess 24, it is contemplated that at least the nodule 32 could be formed from a resiliently deformable material, many of which are known and may include various polymers, and other synthetic and natural materials. It is further contemplated that a plurality of nodules 32 and recesses 24 could be provided in order to secure the mounting post 28 within the socket 20. For example, a preferred shape may be a ridge-shaped nodule 32 that extends substantially around the perimeter of the mounting post 28. In another embodiment, a plurality of rounded nodules 32 could be provided opposite one another (or along other select locations) on the mounting post 28.

Figure 5B:
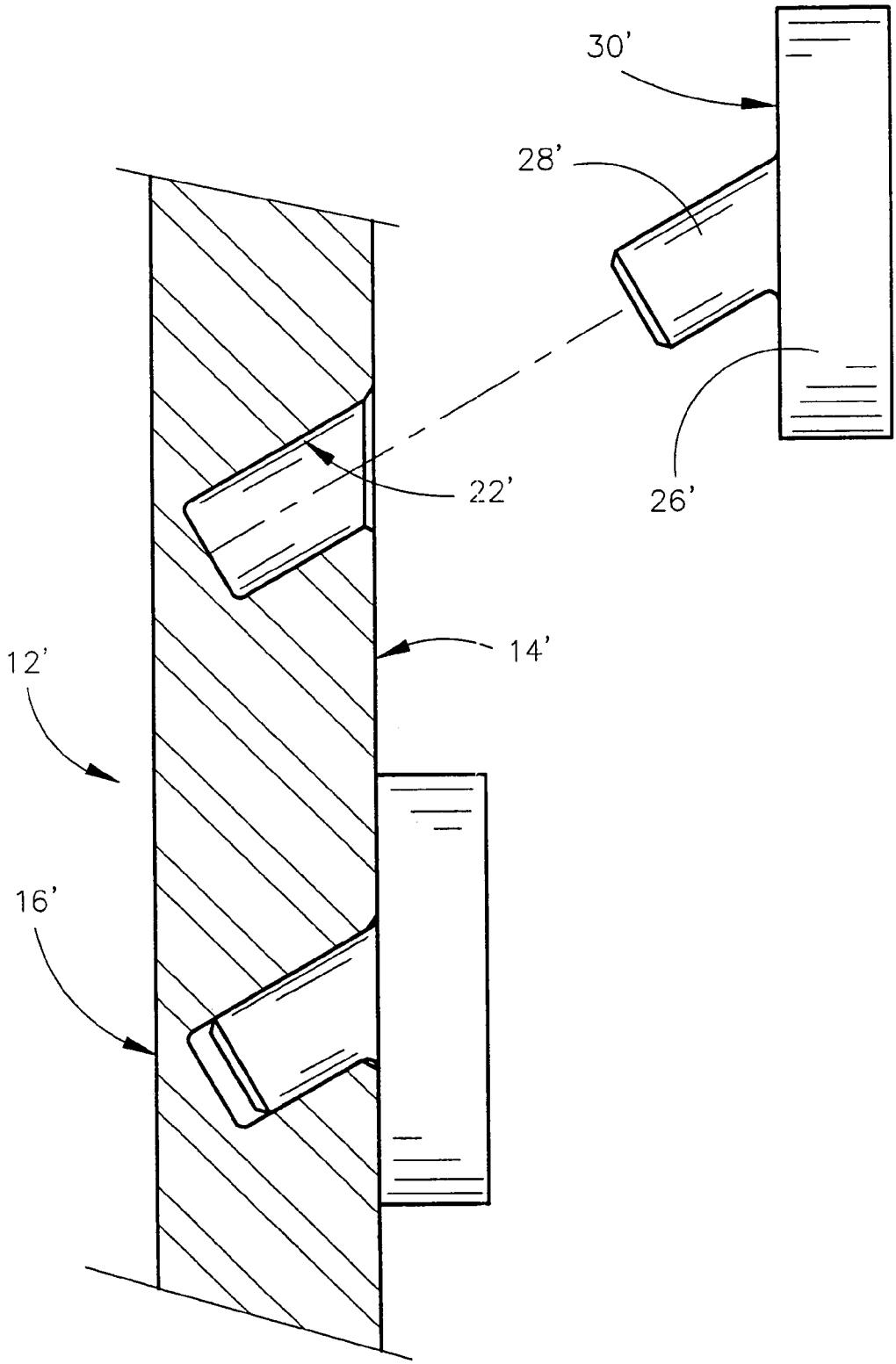
FIG. 5B is a partial cutaway view of an alternate embodiment of the storage system of the present invention.
Figure 6:
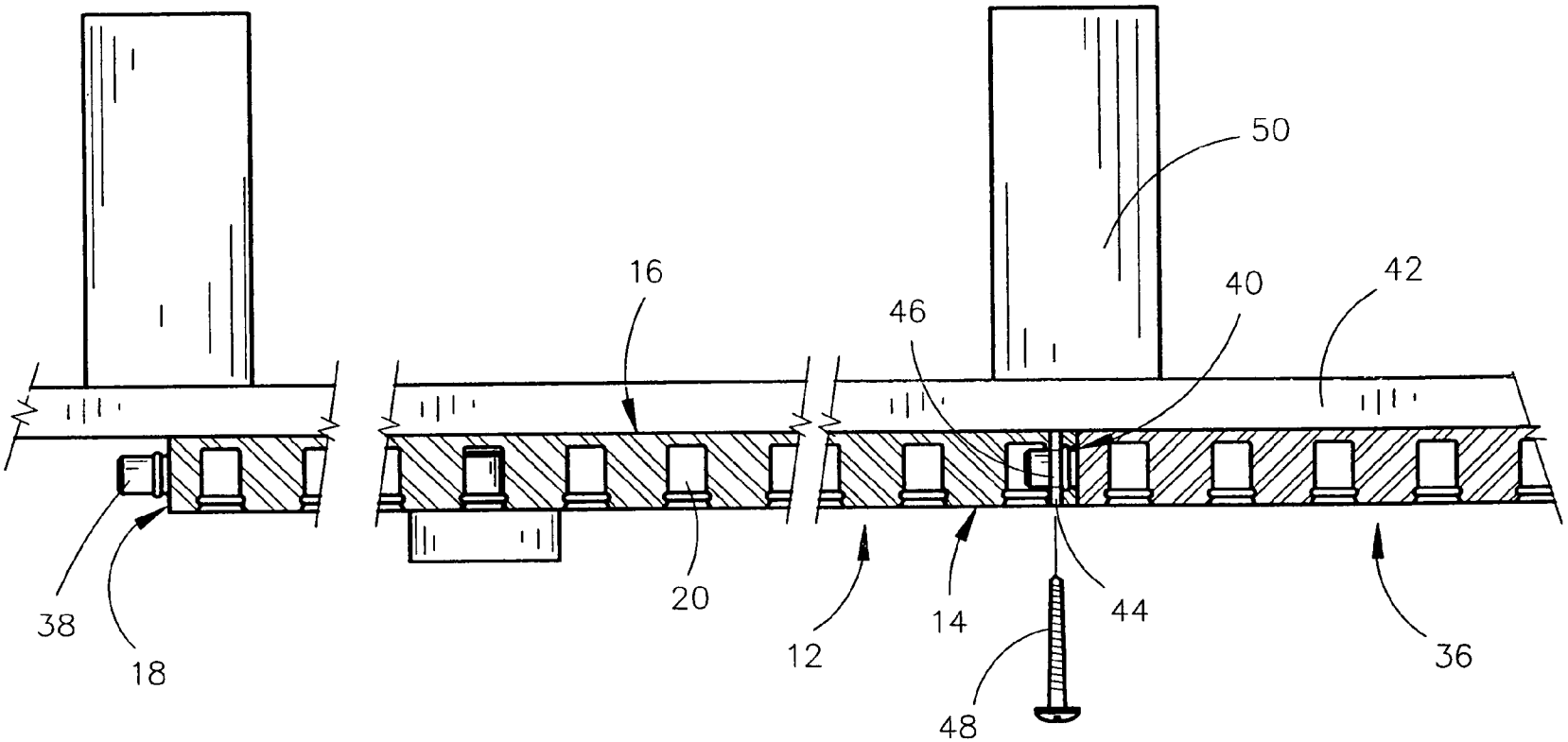
FIG. 6 is another partial, cutaway view of one embodiment of the storage system of the present invention.

In an alternate embodiment, depicted in FIG. 5B, a support member 26' is provided with at least one mounting post 28' that extends outwardly from a first end portion 30' of the support member 26'. The mounting post 28 is preferably shaped and sized to be at least partially received within at least one of the plurality of sockets 20' in the support panel 12'. As depicted, the mounting post 28' lacks the previously described nodule 32 and the socket 20' is not provided with a recess 24. Rather the mounting post 28' extends from the first end portion 30' at an angle, so that the support member 26 is secured in place adjacent the first surface 14' of the support panel 12'. In this manner, the support member 26' may be easily removed by pulling the support member 26' upwardly and way from the support panel 12'. As described previously, the mounting post 28' and socket 20' are each preferably shaped to have a polygonal cross-section, such as a triangle, square, rectangle, etc., so that rotation of the mounting post 28' within the socket 20' is limited. However, round or curved cross-sections are contemplated.

In a preferred embodiment, at least one end of the support member 26 is provided with a structure, such as one or more hooks, pegs, rings, sleeves, cups, clamps, and the like, to support one or more articles. Some examples of these structures are illustrated in FIG. 1. Many of these will be known in the prior art and have been used with pegboard systems to store and organize tools and other articles. It is contemplated, however, that the structures provided in the present system 10 are such that a greater number, size and range of articles can be supported and organized than previously realized in the art. It is further contemplated that one embodiment will simply use a layer of adhesive, disposed on a second end portion of the support member 26. Articles, such as storage bins, tackle boxes, tool holders, and the like, could then be disposed against the layer of adhesive. It is contemplated that the strength of the adhesive chosen will be at least strong enough to permit the support members 26 to be inserted into and removed from the support panels 12 without separating such articles from the support member 26. The strength of the adhesive layer may also depend on the weight of the articles and their contents and will vary from one application to another. Similarly, adhesive could be used on one or more of the support panels 12 to secure them to an operating surface, such as a wall 42.

It will be preferred that the storage system 10 be modular in construction. Accordingly, in one embodiment depicted in FIGS. 6, 8 and 9, at least one side socket 34 extends into the peripheral edge portion 18 of the support panel 12. A second support panel 36 is provided in a similar construction to the first support panel and includes at least one side mounting post 38 that extends from the peripheral edge portion 40 of the second support panel 36. The side socket 34 and the side mounting post 38 are shaped and sized to be releasably engageable with one another, permitting the support panels 12 and 36 to be securely coupled to one another in an edge-to-edge fashion when secured to an operating surface, such as a wall 42. When desirable, a nodule and recess system could be used with the side socket 34 and side mounting post 38, such as described previously hereinabove. Openings 44 and 46 may be formed transversely through the side socket 34 and the side mounting post 38, respectively, in such a manner that the openings 44 and 46 align with one another when the side mounting post 38 is disposed within the side socket 34. In this manner, a mounting apparature is provided to receive a fastener 48 that will secure the two panels to the operating surface, such as the wall 42 and stud 50 shown in FIG. 6. One or more open grooves 52 are formed in the peripheral edge portions 18 and 40 of the support panels 12 and 36. The grooves 52 are shaped and positioned so that, when the support panels 12 and 36 secured to one another, at their respective peripheral edge portions 18 and 40, the grooves 52 form small gaps between the support panels 12 and 36, which are shaped and sized to enable a user to dispose the tip of a screwdriver, or other slender tool or object, into the gap and easily pry the support panels 12 and 36 apart from one another.

Figure 7:
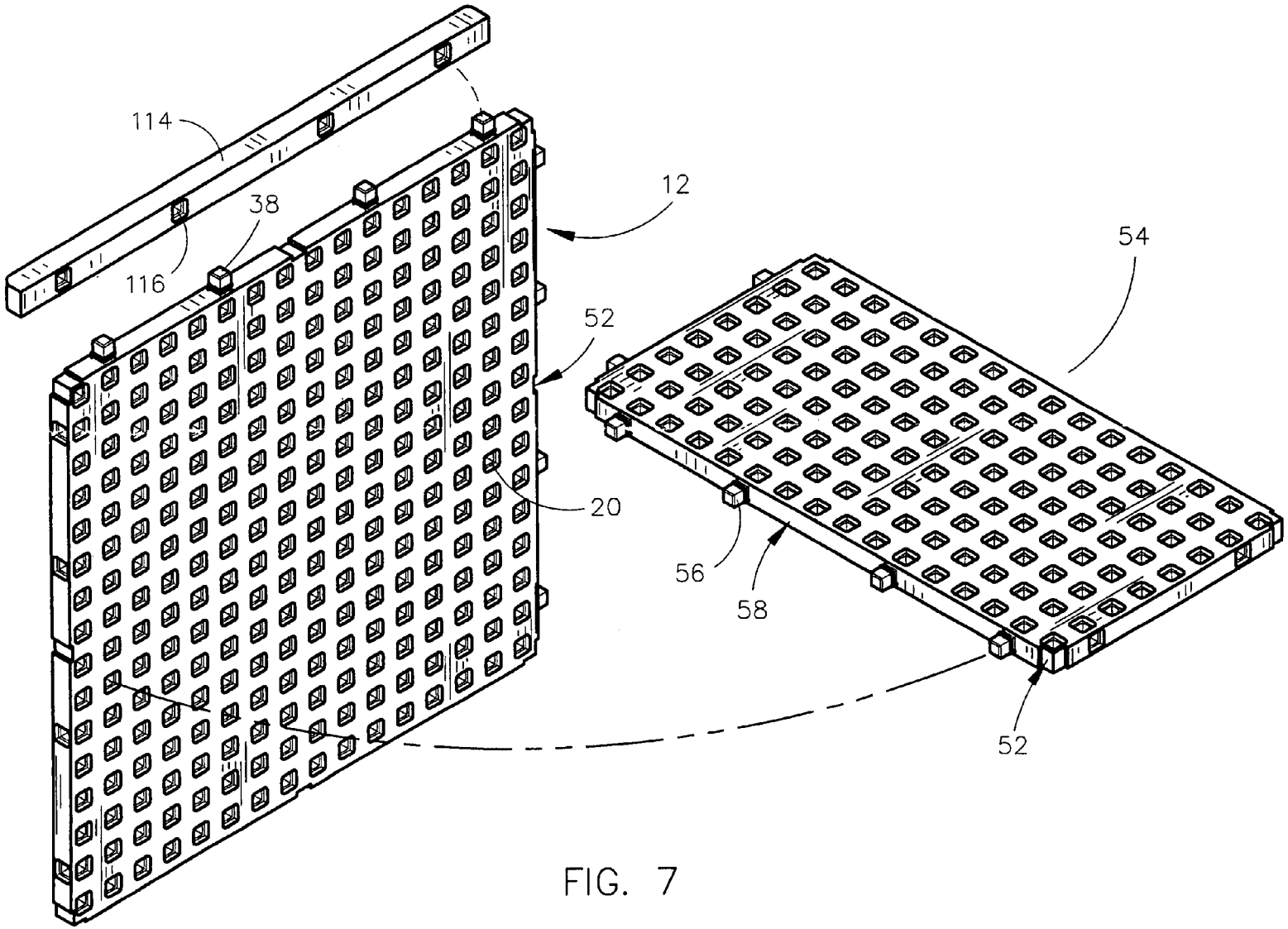
FIG. 7 is an exploded isometric view of a further embodiment of the storage system of the present invention.
Figure 8:
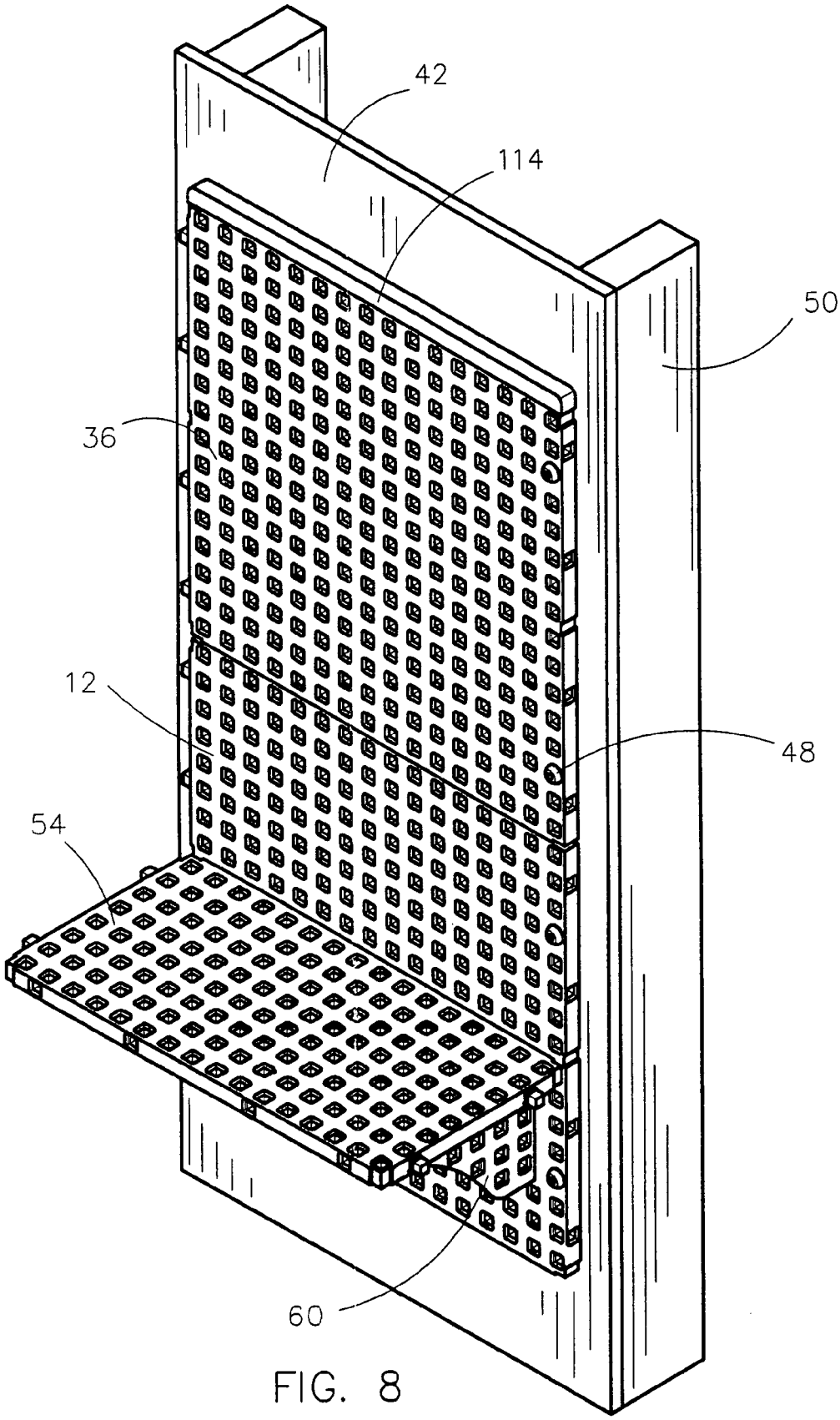
FIG. 8 is an isometric view of one embodiment of the storage system of the present invention that joins support panels to one another in a manner that provides a large, vertically-positioned, support panel, and a horizontally disposed support panel that serves as a shelf within the storage system.
Figure 9:
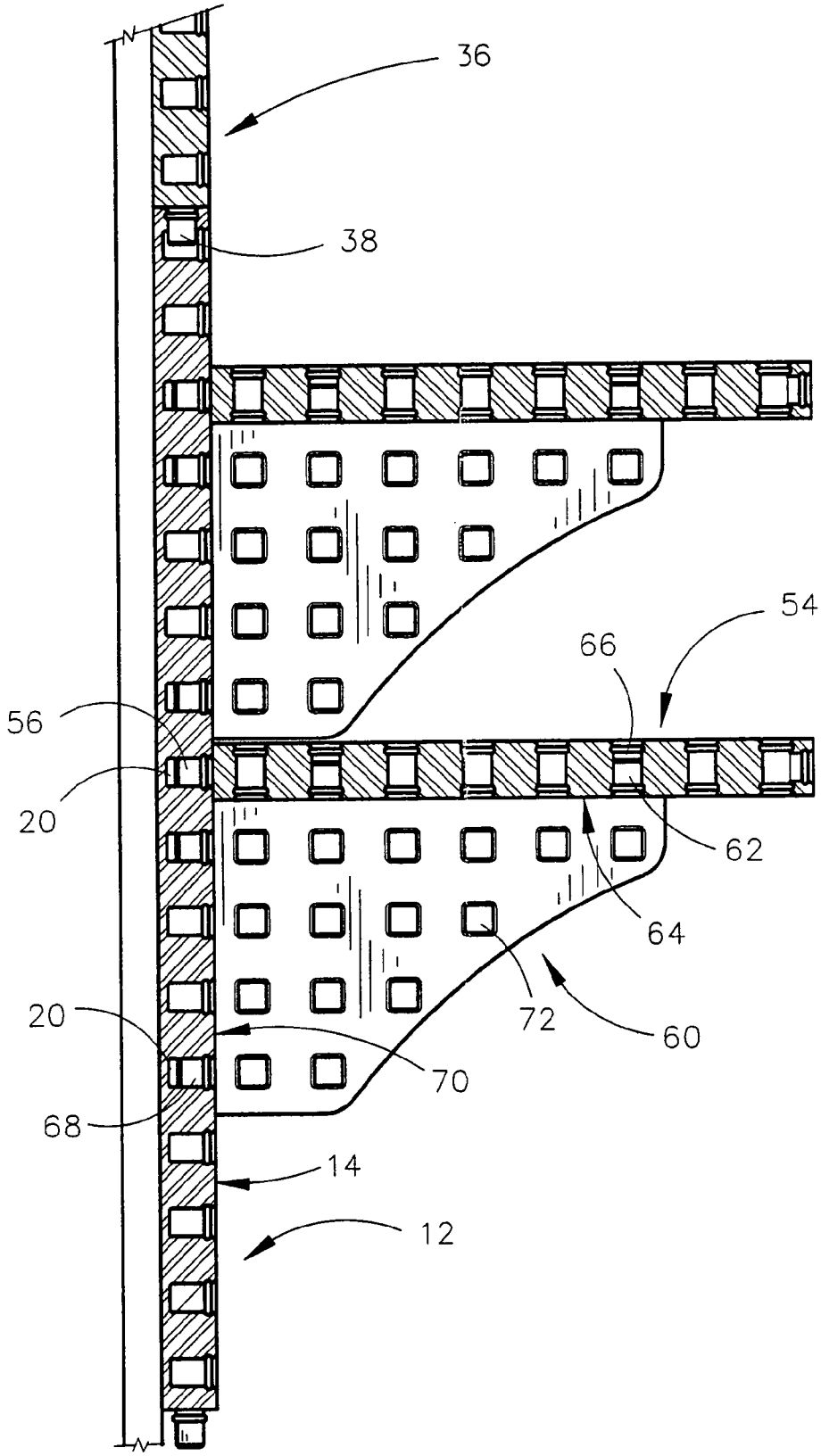
FIG. 9 is a partial, side elevation view of still another embodiment of the storage system of the present invention.
Figure 10:
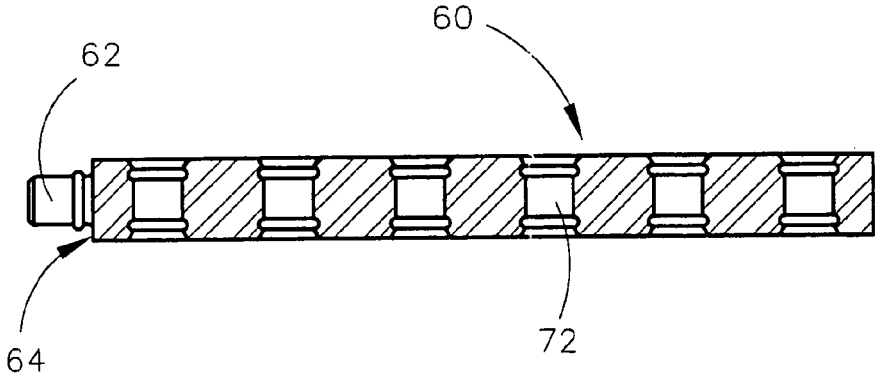
FIG. 10 is a side elevation view of one embodiment of a support panel that may be used within the storage system of the present invention as a shelf.
Figure 11:
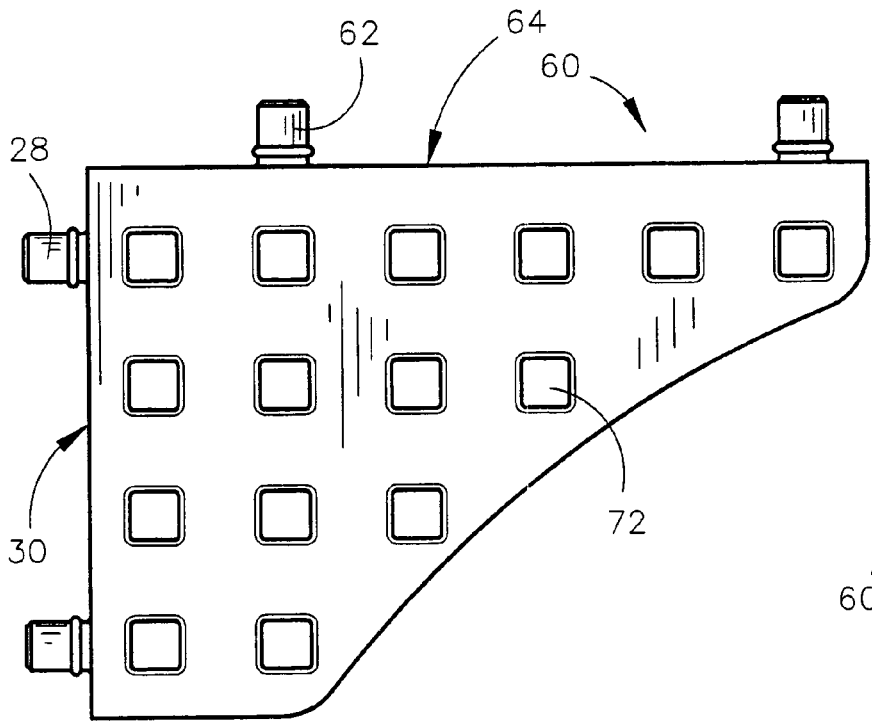
FIG. 11 is a side elevation view of one embodiment of a support member that is configured to be used as a brace for the shelf depicted in FIG. 10.
Figure 12:
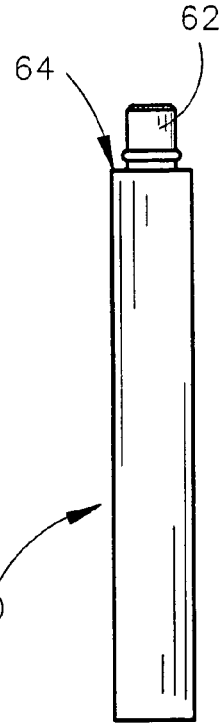
FIG. 12 is a front elevation view of the support member depicted in FIG. 11.
Figure 13:
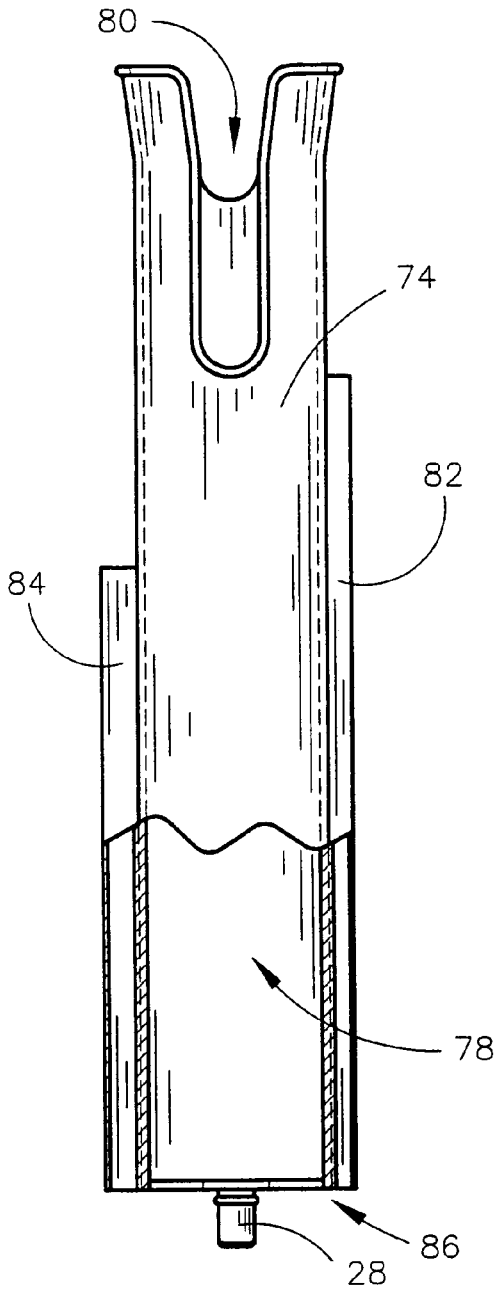
FIG. 13 is a front elevation view of one embodiment of a support member that may be used with the storage system of the present invention for storing articles such as a collapsible fishing pole.
Figure 14:
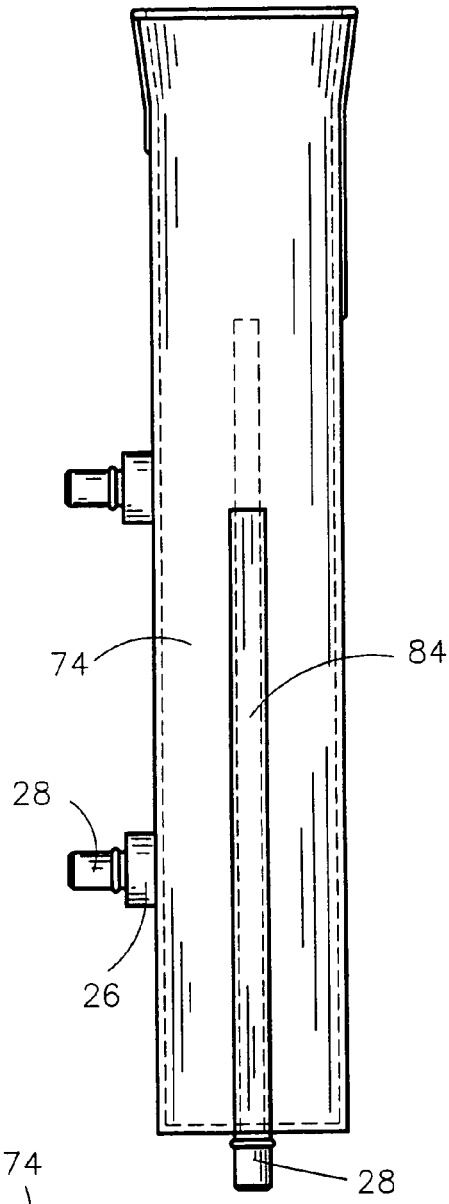
FIG. 14 is a side elevation view of the support member depicted in FIG. 13.
Figure 15:
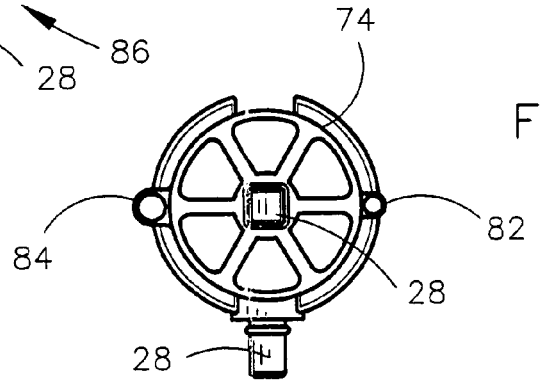
FIG. 15 is a bottom plan view of the support member depicted in FIG. 13.
Figure 16:
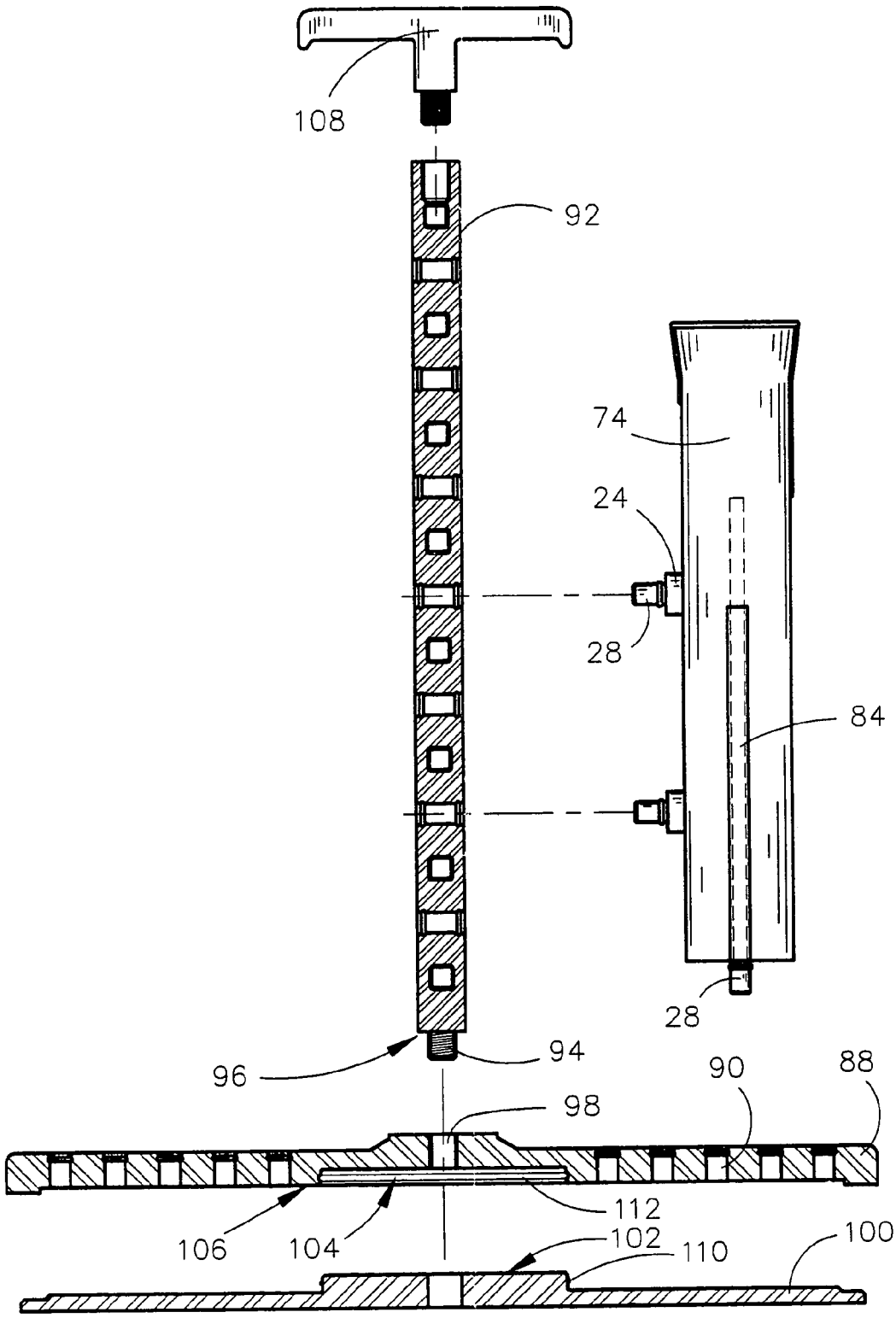
FIG. 16 is an exploded, partially cutaway view of an alternate embodiment of the storage system of the present invention.
Figure 17:
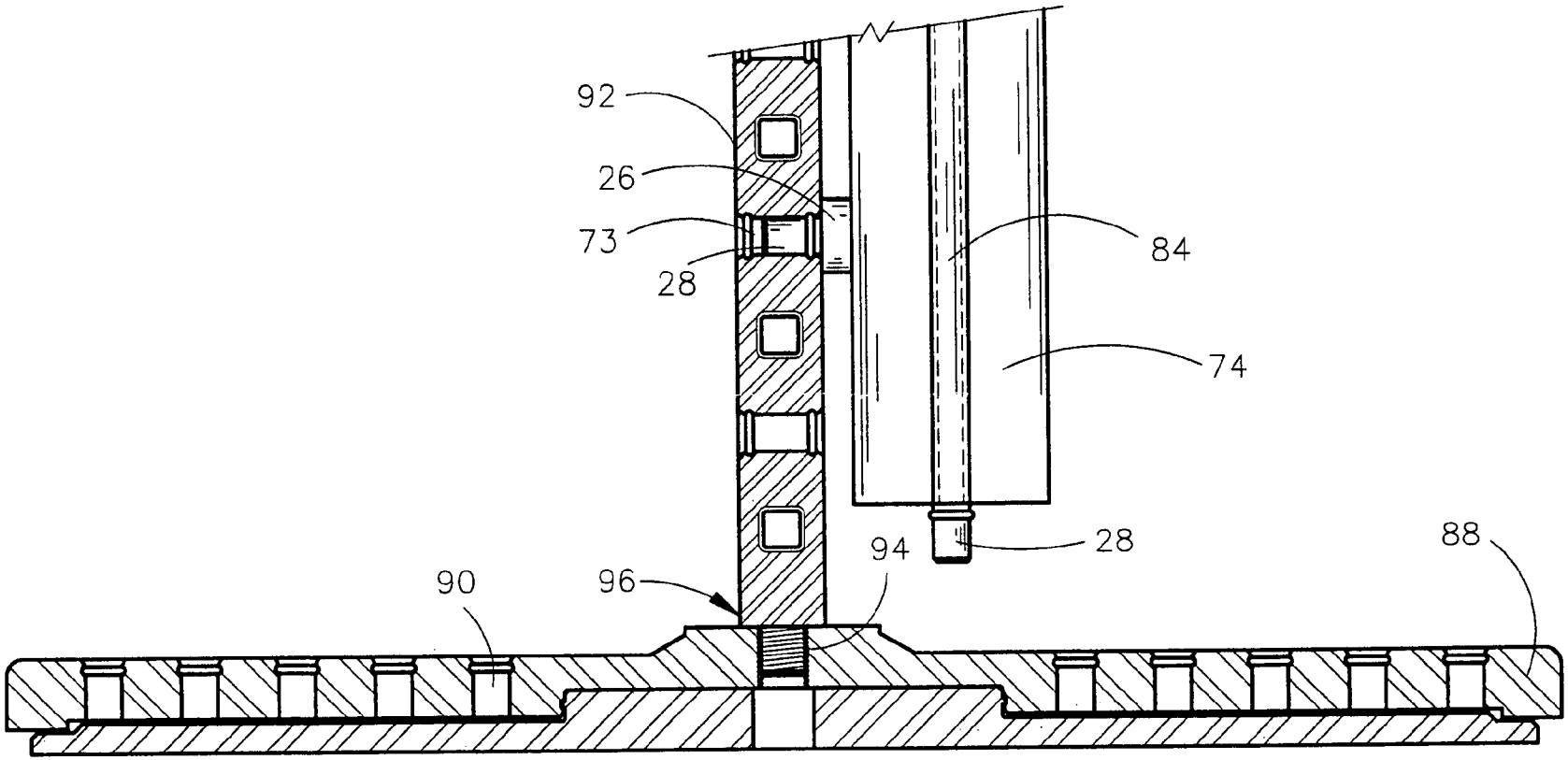
FIG. 17 is a partial, cutaway view of the storage system depicted in FIG. 16, as the same may be assembled.
Figure 18:
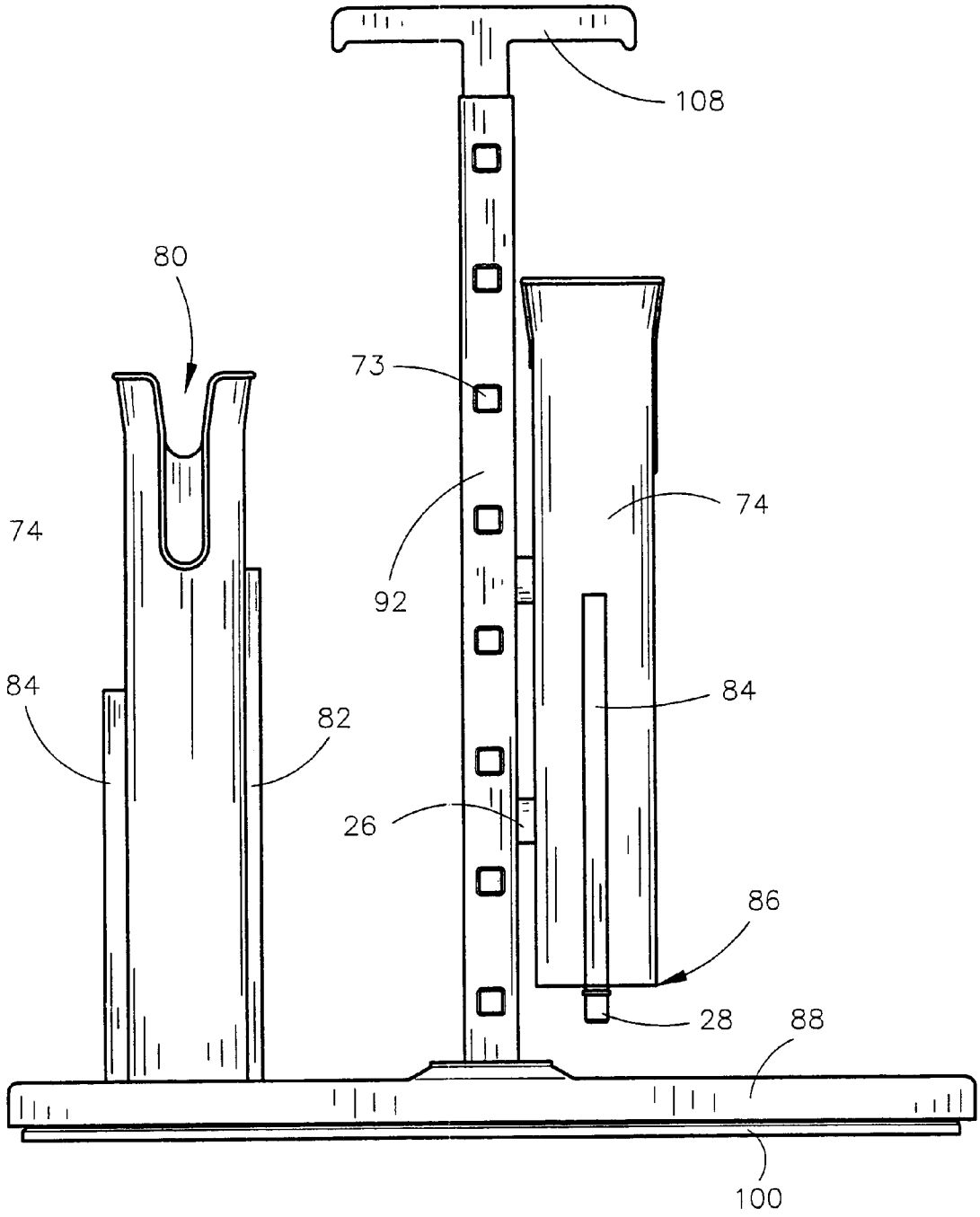
FIG. 18 is a front elevation view of an alternate embodiment of the storage system depicted in FIG. 16.

In another embodiment, depicted in FIGS. 7, 8 and 9, a third support panel 54 may be provided that is generally similar in construction to the support panel 12. However, in a preferred embodiment, the third support panel 54 is provided in a generally narrow and elongated shape. One or more side mounting posts 56 may be provided to extend outwardly from a peripheral edge portion 58 of the third support panel 54. This arrangement permits the peripheral edge portion 58 of the third support panel 54 to be releasably secured adjacent the first surface 14 of the support panel 12, so that the third support panel 54 extends from the first face 14 of the support panel 12 in a generally perpendicular orientation. This arrangement provides for a modular shelf to support various articles. In still another embodiment, a support member 60 is provided with an upper mounting post 62 that extends from an upper edge portion 64 of the support member 60 and is sized and shaped to be at least partially received within at least one socket 66 in the third support panel 54, such that the support member 60 extends in a generally perpendicular fashion from the third support panel 54. A rear mounting post 68 extending from a rearward edge 70 of the support member 60 may be coupled within a socket 20 in the support panel 12 when the third support panel 54 is secured to the first face 14 of the first support panel 12, serving as a brace for the shelf that is formed by the third support panel 54. A plurality of support members 60 may be used in this same fashion and in conjunction with one another in order to provide a desirable level of support. Sockets 72 may be formed in the support member 60 for receiving the mounting posts of other support members 26, which will be utilized to individually support various articles, such as tools and the like. The sockets 72 may be formed to extend completely through the support members 60 to provide a user with mounting access from either side of the support member 60. It is contemplated that the same will be true with any of the sockets and support panels described herein, when the circumstances deem desirable, such as the sockets 73 depicted in FIGS. 16 and 17. In either of the aforementioned embodiments, a nodule and recess system may be used in conjunction with mounting posts and sockets to achieve a secure connection between structures.

In still another preferred embodiment, depicted in FIGS. 13-19, a first elongated sleeve 74 is coupled to a second end portion 76 the support member 26 and is provided with an inner cavity 78 that is in open communication with an open upper end portion 80 of the sleeve 74. Accordingly, the support member 26 may be coupled with the support panel 12 in a manner that permits the sleeve to hold various articles, including the handle portion of a fishing pole, mop, hammer, screw driver, etc. Additional sleeves, such as the second and third sleeves 82 and 84, may be coupled with a side portion of the first sleeve 74 in a generally parallel fashion to receive additional articles for storage, including the upper sections of a fishing pole. In a different embodiment, the mounting post 28 may extend outwardly from a lower end portion 86 of the first elongated sleeve 74 so that the sleeve may be secured to a horizontally disposed platform 88, having one or more platform sockets 90 that are positioned to receive the mounting post 28. A system of nodules and recesses may be employed with the mounting posts and sockets of either embodiment for a secure connection between structures.

Figure 19:
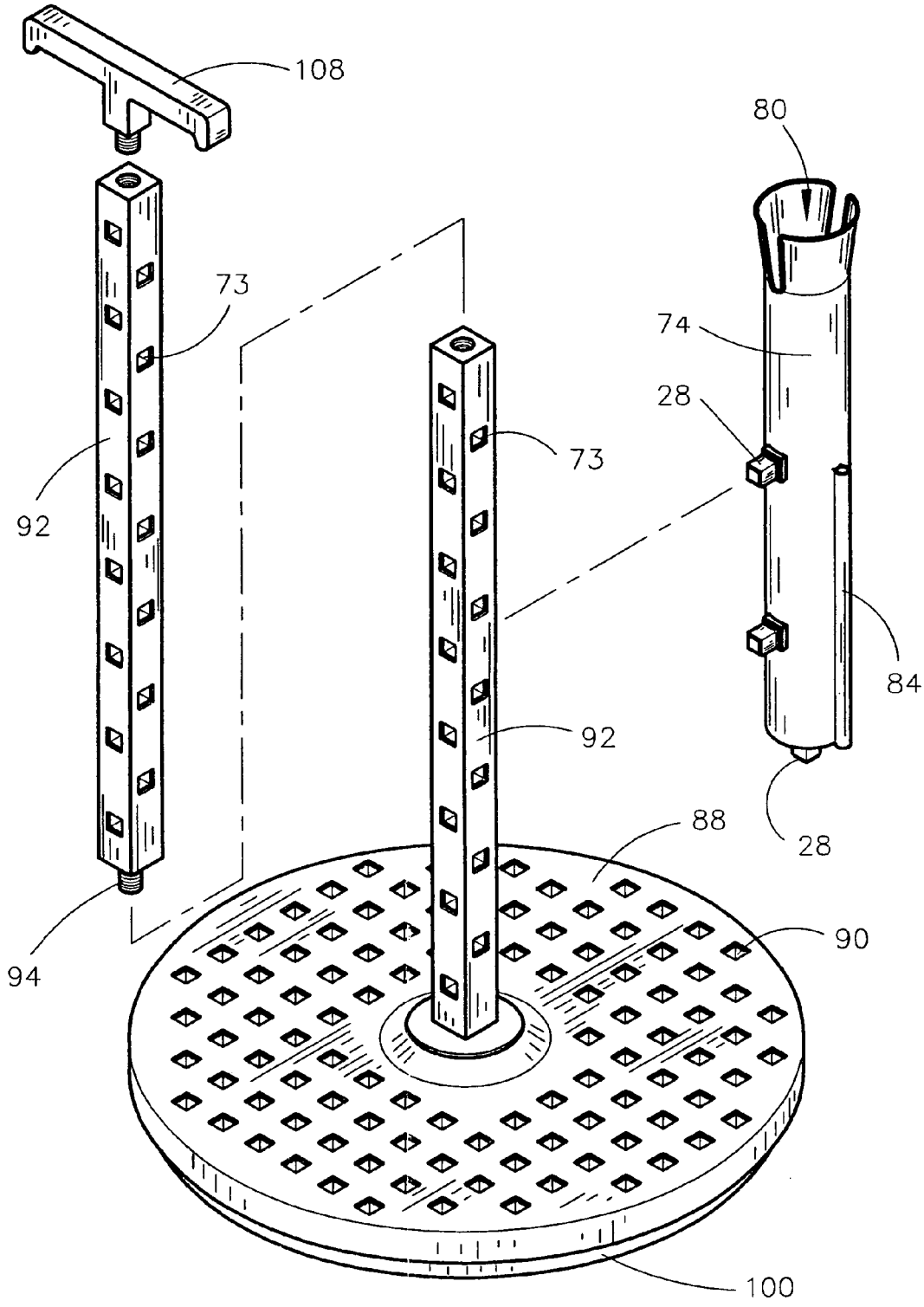
FIG. 19 is a partially exploded, isometric view of an alternate embodiment of the storage system depicted in FIG. 18.

FIGS. 16-19 depict a further embodiment of the storage system 10, wherein a support panel 92 is provided in an elongated slender shape and having a mounting post 94 that extends outwardly from a first end 96 of the peripheral edge portion of the support panel 92. The mounting post 94 may be releasably received within a handle socket 98 formed in the platform 88, permitting the support panel 92 to be used as a handle to move and reposition the platform 88. It is contemplated that the mounting post 94 and the handle socket 98 could be threadably engaged with one another or a nodule and recess system could be used as described hereinabove with respect to the socket 20 and the mounting post 28. Likewise, it is contemplated that a plurality of support panels 92 could be provided to be releasably engaged with one another in an end-to-end fashion, as depicted in FIG. 19 in order to provide a support panel of a desired length. A handle 108 may be releasably or integrally formed with one end of a support panel 92 to provide a user with an easy way of moving the storage system. Furthermore, a base 100 may also be provided, having an upper bearing surface 102 that is rotatably received within a cavity 104 formed in the lower surface 106 of the platform 88. In this arrangement, a selectively rotatable "lazy susan" is provided to store and display articles. A nodule 110 may be provided to extend outwardly from a portion of the base 100 and be selectively engageable within a recess 112 formed within a sidewall of the cavity 104. Preferably, the nodule 110 and recess 112 will snap together much like the nodule 32 and recess 28 described previously.

An elongated finishing cap 114 may be provided to lend a "finished" look to an otherwise exposed edge portion of a support panel 12, having side sockets 34 or side mounting posts 38 along an exposed peripheral edge portion 18. Accordingly, the finishing cap 114 will need to be provided with the appropriate mating sockets 116, or posts, to engage the respective side mounting posts 38, or side sockets 34, as the circumstances necessitate. It is contemplated that the finishing cap 114 could be provided in a wide range of different materials, shapes and colors.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A storage system for articles, comprising:

a support panel having first and second surfaces, a peripheral edge portion, and a plurality of sockets that extend into said support panel from a plurality of openings formed in said first surface; said plurality of sockets each having at least one interior sidewall having a recess that extends into said support panel; at least one side socket extending into the peripheral edge portion of said support panel;

a second support panel having first and second surfaces, a peripheral edge portion, and at least one side mounting post extending from the peripheral edge portion of said second support panel; said at least one side mounting post being sized and shaped to be at least partially received within said at least one side socket such that said support panel and said second support panel become secured to one another at their respective peripheral edge portions; and a support member having first and second end portions and at least one mounting post extending outwardly from said first end portion;

said at least one mounting post being sized and shaped to be at least partially received within at least one of said plurality of sockets in said support panel; said at least one mounting post having at least one nodule extending outwardly from a side portion of said at least one mounting post;

said at least one nodule being releasably receivable within the recess in said at least one interior sidewall, such that said at least one mounting post may be selectively moved into a secured position within at least one of said plurality of sockets;

said at least one side socket being provided with at least one interior sidewall having a recess that extends into said support panel; said at least one side mounting post having at least one nodule extending outwardly from a side portion of said at least one side mounting post that is releasably receivable within the recess in said at least one interior sidewall, such that said at least one side mounting post may be selectively moved into a secured position within said at least one side socket.

2. The storage system of claim 1 wherein said at least one nodule on said at least one side mounting post and said at least one nodule on said at least one side mounting post are comprised of a resiliently deformable material.

3. The storage system of claim 1 further comprising an open groove formed into the peripheral edge portion of said support panel; said groove being shaped and positioned so that, when said support panel and said second support panel are secured to one another, at their respective peripheral edge portions, said groove forms a small gap between said support panel and said second support panel that is shaped and sized to enable a user to dispose the tip of a screwdriver into said gap and pry said support panel and said second support panel apart from one another.

4. A storage system for articles, comprising:

a support panel having first and second surfaces, a peripheral edge portion, and a plurality of sockets that extend into said support panel from a plurality of openings formed in said first surface; said plurality of sockets each having at least one interior sidewall having a recess that extends into said support panel; at least one side socket extending into the peripheral edge portion of said support panel;

a second support panel having first and second surfaces, a peripheral edge portion, and at least one side mounting post extending from the peripheral edge portion of said second support panel; said at least one side mounting post being sized and shaped to be at least partially received within said at least one side socket such that said support panel and said second support panel become secured to one another at their respective peripheral edge portions; and a support member having first and second end portions and at least one mounting post extending outwardly from said first end portion;

said at least one mounting post being sized and shaped to be at least partially received within at least one of said plurality of sockets in said support panel; said at least one mounting post having at least one nodule extending outwardly from a side portion of said at least one mounting post;

said at least one nodule being releasably receivable within the recess in said at least one interior sidewall, such that said at least one mounting post may be selectively moved into a secured position within at least one of said plurality of sockets;

a first opening, formed generally transversely through said at least one side socket in said support panel, and a second opening, formed generally transversely through said at least one side mounting post in said second support panel; said first and second openings being positioned so that they align with one another to form a single opening when said support panel and said second support panel are secured to one another.

5. The storage system of claim 4 further comprising an elongated fastener that is shaped and sized to pass through said first and second openings and secure said support panel and said second support panel to one another and to an operating surface.

6. A storage system for articles, comprising:

a support panel having first and second surfaces, a peripheral edge portion, and a plurality of sockets that extend into said support panel from a plurality of openings formed in said first surface; said plurality of sockets each having at least one interior sidewall having a recess that extends into said support panel; and a support member having first and second end portions and at least one mounting post extending outwardly from said first end portion;

said at least one mounting post being sized and shaped to be at least partially received within at least one of said plurality of sockets in said support panel; said at least one mounting post having at least one nodule extending outwardly from a side portion of said at least one mounting post;

said at least one nodule being releasably receivable within the recess in said at least one interior sidewall, such that said at least one mounting post may be selectively moved into a secured position within at least one of said plurality of sockets;

a second support panel having first and second, surface, a peripheral edge portion, and at least one side mounting post extending from said peripheral edge portion; said at least one side mounting post being sized and shaped to be at least partially received within one of said plurality of sockets such that the peripheral edge portion of said second support panel is secured adjacent the first surface of said support panel, causing said second support panel to extend outwardly from the first surface of said support panel.

7. The storage system of claim 6 wherein said at least one side mounting post is provided with at least one nodule, extending outwardly from a side portion of said at least one side mounting post; said at least one nodule being sized and shaped to be releasably receivable within a recess in one of said plurality of sockets, such that said at least one side mounting post may be selectively moved into a secured position within one of said plurality of sockets.

8. The storage system of claim 6 further comprising at least one upper mounting post extending from an upper edge portion of said support member; said at least one upper mounting post being sized and shaped to be at least partially received within at least one socket formed into the first surface of said second support panel, such that the upper edge portion of said support member support panel may be selectively secured adjacent the first surface of said second support panel when said at least one mounting post, extending from the first end portion of said support member, is moved into a secured position within at least one of said plurality of sockets formed in said support panel.

9. The storage system of claim 8 further comprising a second support member having first and second end portions and at least one mounting post that extends outwardly from said first end portion and is sized and shaped to be at least partially received within at least one side socket formed into a side surface of said support member; said second end portion of said second support member being shaped to support at least one of the articles.

10. The storage system of claim 9 wherein said at least one mounting post extending from said second support member is provided with at least one nodule extending outwardly from a side portion of said at least one mounting post; said at least one nodule being releasably receivable within a recess formed within an interior sidewall of said at least one side socket, such that said at least one mounting post may be selectively moved into a secured position within said at least one side socket.

11. A storage system for articles, comprising:

a support panel having first and second surfaces, a peripheral edge portion, and a plurality of sockets that extend into said support panel from a plurality of openings formed in said first surface; said plurality of sockets each having at least one interior sidewall having a recess that extends into said support panel;

a support member having first and second end portions and at least one mounting post extending outwardly from said first end portion;

said at least one mounting post being sized and shaped to be at least partially received within at least one of said plurality of sockets in said support panel; said at least one mounting post having at least one nodule extending outwardly from a side portion of said at least one mounting post;

said at least one nodule being releasably receivable within the recess in said at least one interior sidewall, such that said at least one-mounting post may be selectively moved into a secured position within at least one of said plurality of sockets; and a first elongated sleeve, having an exterior surface and an inner cavity that is in open communication with open upper end portion; said exterior surface being operatively coupled to the second end portion of said support member.

12. The storage system of claim 11 further comprising a second elongated sleeve, having an exterior surface and an inner cavity that is in open communication with an open upper end portion; said exterior surface being operatively coupled to the exterior surface of said first elongated sleeve so that said first and second elongated sleeves are positioned in a generally parallel relationship with one another.

13. The storage system of claim 12 further comprising a third elongated sleeve, having an exterior surface and an inner cavity that is in open communication with an open upper end portion; said exterior surface being operatively coupled to the exterior surface of said first elongated sleeve so that said first and third elongated sleeves are positioned in a generally parallel relationship with one another.

14. The storage system of claim 11 wherein a lower end portion of said first elongated sleeve is coupled to the second end portion of said support member so that a long axis of said first elongated sleeve and a long axis of said support member are generally parallel with one another.

15. The storage system of claim 11 wherein a side portion of said first elongated sleeve is coupled to the second end portion of said support member so that a long axis of said first elongated sleeve and a long axis of said support member are generally perpendicular with one another.

16. The storage system of claim 11 further comprising a generally planar platform having first and second surfaces, a peripheral edge portion, and at least one support panel socket that extends into said platform from at least one opening formed in said first surface; said handle socket being shaped and sized to receive at least one mounting post that extends outwardly from a first end of the peripheral edge portion of said support panel.

17. The storage system of claim 16 wherein said support panel socket and said mounting post are threadably engageable with one another.

18. The storage system of claim 16 further comprising a handle, having at least one mounting post that is releasably secureable within a handle socket that extends into a second end of the peripheral edge portion of said support panel.

19. The storage system of claim 16 comprising a base having first and second surfaces and a bearing surface that extends outwardly from said first surface; said bearing surface being rotatably engageable within a recess formed in the second surface of said platform, so that said platform may be selectively rotated with respect to said base.

20. The storage system of claim 19 further comprising a plurality of platform sockets that extend into said platform from a plurality of openings formed in the first surface of said platform; said plurality of platform sockets each being shaped and sized to receive said mounting post, when a lower end portion of said first elongated sleeve is coupled to the second end portion of said support member so that a long axis of said first elongated sleeve and a long axis of said support member are generally parallel with one another.

* * * * *